United States Patent [19]

Kiessling

[11] 4,030,054

[45] June 14, 1977

[54] PNEUMATIC TIMING ATTACHMENT FOR AN ELECTROMAGNETIC DEVICE

[75] Inventor: Rudolf H. Kiessling, Glendale, Wis.

[73] Assignee: Square D Company, Park Ridge, Ill.

[22] Filed: Dec. 23, 1975

[21] Appl. No.: 643,883

[52] U.S. Cl. ..... 335/61; 335/60

[51] Int. Cl.[2] ..... H01H 7/03; H01H 43/00

[58] Field of Search ..... 335/61, 60, 59, 62, 335/29, 240; 200/34

[56] References Cited

UNITED STATES PATENTS

| | | | |
|---|---|---|---|
| 2,656,434 | 10/1953 | Jochem | 335/60 |
| 3,249,716 | 5/1966 | Haydu et al. | 335/60 |
| 3,254,177 | 5/1966 | Gottsacker et al. | 335/60 |

*Primary Examiner*—Harold Broome

*Attorney, Agent, or Firm*—William H. Schmeling; Richard T. Guttman

[57] ABSTRACT

A timing attachment for a relay which may be easily programmed to provide an ON delay or an OFF delay operation of a switch having either normally open or normally closed contacts. The attachment includes a pair of identical latch levers and a pair of identical levers which operate to reset a timing mechanism and cause the timer to operate in the OFF or ON delay modes. The timing mechanism includes a pair of relatively rotatable discs having flat contacting surfaces with one of the discs having a pair of dead-ended concentric grooves and the other disc having an elongated hole which connects the concentric grooves at selected positions along their lengths to provide a metering air duct having a length that varies from zero to the full length of both grooves to provide a minimum to maximum time delay timing operation.

11 Claims, 10 Drawing Figures

PNEUMATIC TIMING ATTACHMENT FOR AN ELECTROMAGNETIC DEVICE

This invention relates to pneumatic timers and is more particularly concerned with a timing attachment for use in connection with electromagnetically actuated devices, such as relays, contactors and the like, to provide either an OFF delay or ON delay operation of either normally open or normally closed switching contacts in response to the energization or de-energization of the device.

The use of pneumatic timing attachments in connection with devices such as relays, contactors and the like, to provide a timed delay operation of switching contacts after the device is either energized or de-energized is well known and is usually accomplished by mounting the attachment on the structure carrying the instantaneous switching contacts of the device, as illustrated by U.S. Pat. No. 3,254,177, granted to R. F. Gottsacker et al. on May 31, 1967. While the timing device as disclosed in the Gottsacker patent has proven satisfactory in many respects, it was designed so that conversion of the timing mode required that one part of the device be disassembled from the remainder so its position in the assembly could be reversed. Thus the conversion of the mode of operation required the wires to the device be removed while the conversion was made. Additionally, as the Gottsacker attachment includes a single double pole switch, the attachment is capable of providing only a single normally open and a single normally closed contact operation. Another type of timing device which may be used with a relay is illustrated in U.S. Pat. No. 3,249,716 which was granted to J. L. Haydu on May 3, 1966. The device as disclosed in the Haydu patent also included an arrangement wherein the device is mounted on the structure carrying the instantaneously operated contacts of the relay and is designed so the conversion of the timing mode of he device required a partial disassembly and reassembly of the device and the wires to the device be removed when the switching operation of the device is changed.

The timing attachment according to the present invention is arranged so that it may be used with a relay having a plurality of switches having either normally open or normally closed instantaneously operated contacts. The attachment includes a single lever which may be positioned to cause the attachment to provide an ON or OFF delay operation without partly disassembling and reassembling parts of the attachment as is required by prior art devices and switches which may be reprogrammed to provide a normally open or normally closed contact operation without disturbing the wires to the switches.

It is an object of the present invention to provide a relay with an attachment wherein the same switch modules are used in the relay and attachment to provide the relay with an ON delay or OFF delay contact operation conjointly with an instantaneous contact operation of normally open or normally closed contact operation of any one of the switch modules which may be programmed without disturbing any wire connections to the switch modules.

An additional object is to provide a timing attachment for a relay which will permit the relay to be converted from a relay having switching contacts that operate instantaneously when the relay is energized and de-energized to a relay having contacts that operate instantaneously as well as contacts that operate with an ON or OFF delay contact operation after the relay is energized and de-energized and to use the same switch modules in both the relay and attachment to provide either a normally open or normally closed contact operation, the operation of which may be converted without disturbing any of the wiring to the switch modules.

A further object is to provide a timing attachment for a relay which will permit the relay to be converted from a relay having switching contacts that operate instantaneously when the relay is energized and de-energized, to a relay which may be easily programmed by the simple rotation of a single lever to a relay having instantaneously operated contacts as well as contacts that operate to provide either an ON delay or OFF delay contact operation after the relay is energized and de-energized and to use the same switch modules in the relay and attachment which can be converted to provide a normally open or normally closed contact operation without disturbing any of the wires to the switch modules or detaching the attachment from the relay.

Another object is to provide a timing attachment for a relay with a timing unit that includes a disc having a pair of concentric capillary grooves in one of its faces which are bridged at selected locations along their lengths to cause the timing unit to provide a timing interval of selected duration.

Further objects and features of the invention will be readily apparent to those skilled in the art from the following specification and from the appended drawings illustrating certain preferred embodiments, in which.

Figure 1:
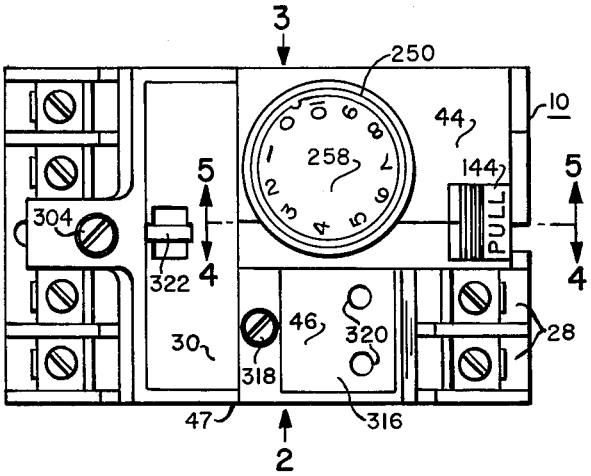
FIG. 1 is a front plan view of a relay having a timing attachment according to the present invention mounted thereon.

In the drawings, a time delay device incorporating the features of the invention is shown as mounted as an attachment 10 on an electromagnetically operated device, such as a relay 12. As the structure and operation of the relay 12 is fully disclosed and claimed in the U.S. Pat. No. 3,835,425, which was granted on Sept. 10, 1974 to Walter C. Karch, Kenneth J. Marien and Robert C. Mierendorf, a detailed explanation of the relay structure will not be made herein, other than that required to understand the operation of the attachment 10 and its cooperation with the relay 12.

The relay 12, as disclosed in the Karch et al. patent, includes a pair of connected housing parts 14 and 16, which enclose an electromagnet assembly, not shown. The electromagnet assembly includes a magnet coil, a stationary magnet part and an armature, a pair of levers 18 and 20, which rotate when the electromagnet assembly is energized and de-energized, a row of spaced plungers 22, and a row of spaced plungers 24. The relay 12, when supplied without the timing attachment, has a pair of housings that are mounted side by side, only one of which is shown as housing 26 in the drawings. The housings 26 provide a plurality of spaced compartments, each of which includes a switch module 28. The compartments are closed by a cover, not shown, which is replaced by a portion 30 of the attachment 10 when the relay 12 is supplied with a timing attachment 10. When the relay 12 is supplied without a timing attachment 10, a housing containing switches identical with the housing 26 and switch modules 28 is secured in the position occupied by the timing attachment 10 in the drawings.

Figure 2:
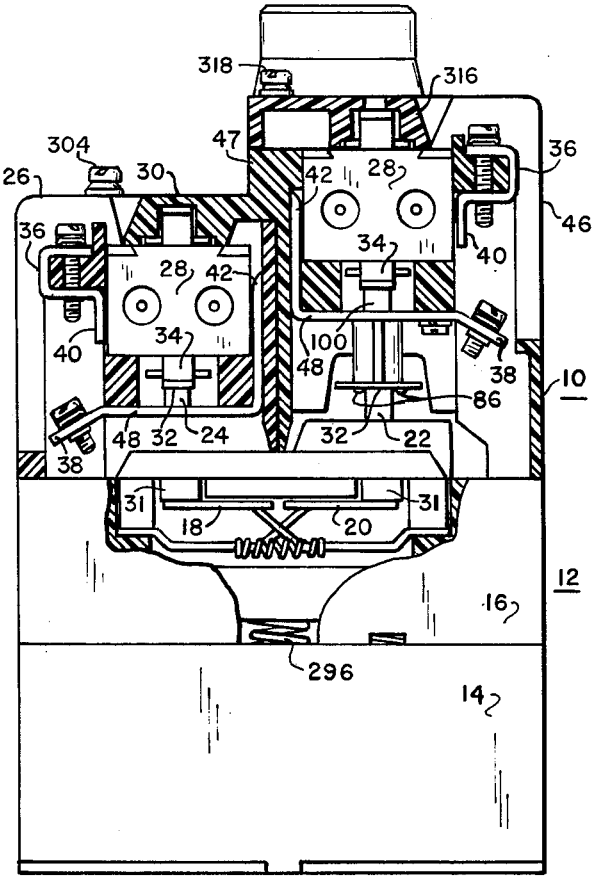
FIG. 2 is a side view of a relay with a timing unit according to the present invention mounted thereon when viewed in the direction indicated by arrow 2 in FIG. 1, with portions of the relay broken away and portions of the relay and attachment shown in section to better illustrate the interior thereof.

The relay 12, including the timing attachment 10, as illustrated in FIG. 2, is shown in its de-energized condition with the levers 18 and 20 extending generally in a common plane. The lever 18 rotates rearwardly counterclockwise and the lever 20 rotates rearwardly clockwise in FIG. 2 when the relay is energized. The plungers in the rows 22 and 24 each have an end 31 engaging the levers 20 and 18, respectively. Thus, when the levers 18 and 20 rotate counterclockwise and clockwise respectively, the plungers will cause their associated front ends 32 to move rearwardly. The front ends 32 of the plungers in row 24 each engage a rear end on a plunger 34 of switch module 28. The front ends 32 of the plungers in row 22 engage components in the attachment 10, as will be later described. The switch modules 28 in the housing 26 and attachment 10 have movable and stationary contacts arranged to provide each switch module 28 with a normally closed contact operation when the module 28 is oriented in one direction in its associated socket and a normally open contact operation when the module 28 is inverted from the position which it provides the normally closed operation in its associated socket, as disclosed in the Karch et al. patent, supra. Further, as disclosed in the Karch et al. patent, each socket for each module 28 has a pair of terminal members that provide wire connecting portions 36 and 38 extending externally of the housing 6 and portions 40 and 42 located within its associated socket. The portions 40 and 42 are located adjacent the opposite side walls of the switch module to electrically engage spring biased supports for the stationary contacts within the switch module 28. The engagement between the portions 40 and 42 and the spring biased stationary contact supports within each module 28 permits the conversion from a normally open to a normally closed contact operation and vice versa of any switch module 28 without disturbing the wired connections to the terminals 36 and 38 associated with a switch module 28 during the conversion. Thus the switch modules 28 within the sockets in the housing 26 will be actuated and de-actuated to provide their programmed contact operation whenever the relay 12 is energized and de-energized.

The timing attachment 10 can be considered as having two sections which are carried by two connected housing parts designated as the timing unit 44 and the latch and switch unit 46. The latch and switch unit 46 is most clearly illustrated in FIGS. 1, 2 and 4 and positions the components shown in FIGS. 8 and 9. The unit 46 includes a molded insulating housing part 47. The part 47 includes the cover portion 30 and provides a pair of sockets each having a switch module 28 positioned therein and a support for terminal members which have portions 40 and 42 located in the sockets to make electrical contact with the stationary contacts of the switch modules 28 so the operation of the module 28 may be converted in the same manner as disclosed in the Karch et al. patent, supra. When positioned in the socket, each of the switch modules 28 will present an end of its operation plunger 34 that is located in a space between the rear end of the module and the portion 48 of the terminal that connects the wire connecting terminal 38 with the portion 42 that engages the stationary contact of the module 28.

Figure 4:
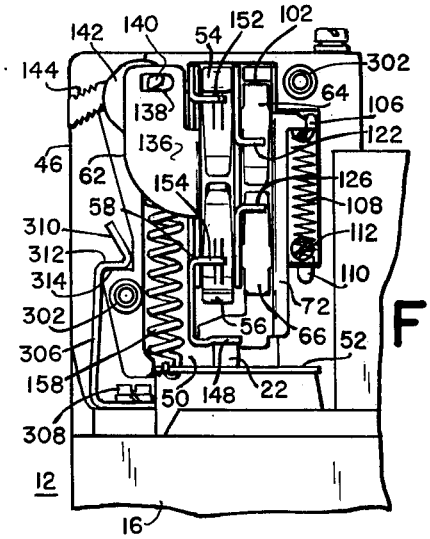
FIG. 4 is a side view of a portion of the attachment taken along line 4—4 in FIG. 1 when viewed in the direction indicated by the arrows 4.
Figure 8:
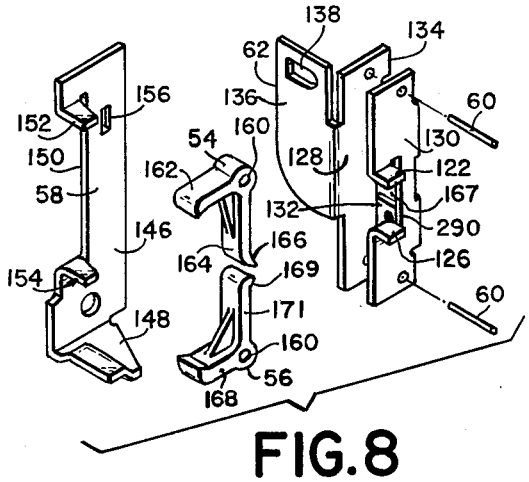
FIG. 8 is an exploded view showing in perspective certain components which reset the timing mechanism and program the timing mode of the attachment.
Figure 9:
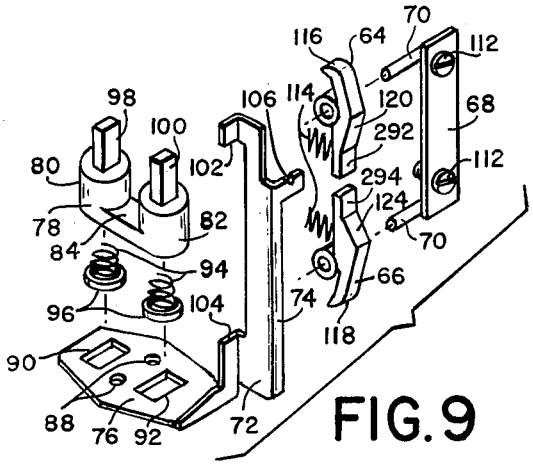
FIG. 9 is an exploded view showing in perspective the parts which provide the latching function of the switch operation of the attachment.

The units 44 and 46 are secured together to provide a closed internal cavity 50, the rear end of which is closed by a flat metal plate 52, illustrated in FIG. 4. The components included within the cavity 50 providing the reset function and the mode of operation of the timing attachment are shown in FIG. 8 and the components which provide a latch and switch operation function are shown in FIG. 9. The timer reset mechanism, shown in FIG. 8, includes a pair of identical levers 54 and 56 and a movable slide 58 which selectively actuates the levers 54 and 56. The levers 54 and 56 are pivoted on pins 60 supported on a slideable mode selecting member 62. The member 62 is selectively positioned in either of two positions in the cavity 50 to program the operation of the timing attachment 10. The latch and switch actuation components illustrated in FIG. 9 include a pair of identical levers 64 and 66, a metal plate 68, two pins 70 which provide a pivot support for the levers 64 and 66, and a slideable and latchable switch actuating means. The switch actuating means includes a metal member 72 formed to have a leg portion 74 and a foot portion 76 extending perpendicular at the rear end of the leg portion 74. Secured on the front side of the foot portion 76 is a member 78, preferably molded of insulating material, having a pair of spaced cylindrical portions 80 and 82 that are interconnected by a portion 84. The portion 84 is secured to the front side of the foot portion 76 by projections 86, shown in FIG. 2, that extend through openings 88 in the foot portion 76. The projections 86 are preferably hot-upset to establish the secured connection between the member 78 and the front side of the foot portion 76. The cylindrical portions 80 and 82 are aligned with openings 90 and 92 in the foot portion 76 and each contains a hollow cylindrical interior, not shown, centered on the openings 90 and 92. Positioned within each of the cylindrical interiors of the cylindrical portions 80 and 82 is a spring 94 and a spring seat 96, which are arranged so the spring seat 96 is constantly urged toward engagement with the front surface of the foot portion 76. Extending forwardly from the front ends of the cylindrical portions 80 and 82 are projections 98 and 100, respectively, which are located and sized to extend through suitably located openings in the portion 48 into engagement with a rear end of the plungers 34 of the switch modules 28 which are aligned forwardly of the projections 98 and 100.

The member 72 also has an ON delay latching surface 102 located at its forward end, an OFF delay latching surface 104 at its lower end, and a hook 106 extending from the leg portion 74. The member 72 is slidably positioned in the cavity 50 by the walls of the cavity and is urged toward the plate 52 by a spring 108 having one end secured to the hook 106 and its other end secured to a boss 110 formed on the housing part 47. The metal plate 68 is secured to the wall portion of housing part 47 forming the cavity 50 by a pair of screws 112, one of which is shown in FIG. 4, and positions the pair of pins 70 which provide pivots for the pair of levers 64 and 66. The levers 64 and 66 are each biased by an individual spring 114 which is spaced from the pins 70 so the lever 64 is urged in a counterclockwise direction and the lever 66 is urged in a clockwise direction of rotation in FIG. 9. The lever 64 has a latch surface 116 which is engageable with the ON delay latch surface 102 when the lever 64 is at its furthest counterclockwise position and the lever 66 has a latch surface 118 which engages the OFF delay latch surface 104 when the lever 66 is at its furthest clockwise position.

The lever 64 additionally has a surface portion 120 that is engaged by tab 122 on the member 62 so as to rotate the lever 64 clockwise to a position where the engagement between the latch surfaces 102 and 116 is prevented when the mode selecting member 62 is at its OFF delay position in the cavity 50. Similarly, the lever 66 has a surface portion 124 that is engaged by a tab 126 on the member 62 and rotated counterclockwise to a position where engagement between the latch surfaces 104 and 118 is prevented when the mode selecting member 62 is at its ON delay position in the cavity 50.

The mode selecting member 62 is formed as a channel-shaped metal part to have a pair of arms 128 and 130 interconnected by a bight portion 132. The bight portion 132 is slidably movable on the wall of the housing part 47 and the arm 128 carries a pair of spaced nibs 134, one of which is shown in FIG. 8, which are received in slots, not shown, in a wall portion of the housing part 47 to guide the movement of the member 62 in the cavity 50. The tabs 122 and 126 are spaced in the arm 130 and extend to engage the surfaces 120 and 124, as previously described. Extending from the free edge of arm 128 in a direction opposite from the tabs 122 and 126 is an ear 136 having an opening 138 therein. The opening 138 is located to receive a projection 140 extending from a side wall of a cylindrically shaped part 142, shown in FIG. 4. The part 142 is rotatable in a suitably shaped recess in the housing 47 and is provided with a bore, not shown, that receives a stem, not shown, extending from a handle 144 projecting from the part 142. The handle 144 is spring-biased and the stem on the handle has an end arranged to move out of engagement with either of two indexing detent depressions in the housing 47 when the handle 144 is pulled outwardly from the part 142 and rotated to either of the two detent positions. The arms 128 and 130 are also provided with suitable openings for positioning the pins 60 so the pins 60 extend in the space between the arms 128 and 130.

The slide 58 includes a leg portion 146 and a foot portion 148 extending perpendicular to the leg portion 146 at the rear end of the leg portion 146. The leg portion 146 extends parallel and adjacent the outer surface of the arm 128 while the ear 136 overlays an edge 150 that extends between a pair of spaced tabs 152 and 154 projecting from the same side of leg 146 as the foot portion 148. Projecting outwardly from the side of the leg portion 146 that is opposite the direction in which tabs 152 and 154 extend is a hook formed by the struck-out material forming opening 156 which receives one end of a tension spring 158, shown in FIG. 4. The spring 158 has its other end hooked on the plate 52 and constantly urges the foot portion 148 into engagement with the front end of a plunger in row 24 that is located rearwardly of the foot portion 148, as in FIG. 4. The levers 54 and 56 are positioned by their pivot portions 160 on the pins 60 between the arms 128 and 130. The lever 54 has arm portions 162 and 164 extending at right angles from its associated pivot portion 160. The front free end on the arm 162 is positioned to be engaged by the tab 152 during movement of the slide 58 and the free end on the arm 164 is arranged to move through an opening 167 in the bight portion 132 when the lever 54 is rotated about its pivot portion 160 in response to the movement of the slide 58. Similarly, the lever 56 has arm portions 168 and 171 extending at right angles from its associated pivot portion 160. The front free end on the arm 168 is positioned to be engaged by the tab 154 during movement of the slide 58 and the free end 169 on the arm 171 is arranged to move through the opening 167 when the lever 56 is rotated about its pivot portion 160 in response to the movement of the slide 58.

Figure 5:
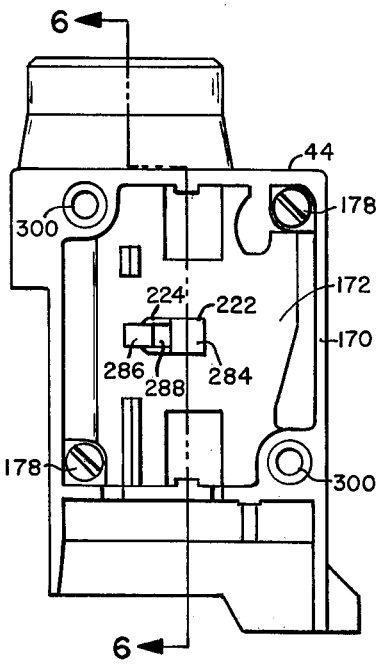
FIG. 5 is a side view of a portion of the attachment taken along line 5—5 in FIG. 1 when viewed in the direction indicated by the arrows 5.

The timing unit 44 includes a housing which encloses a pneumatic timing mechanism of the attachment 10 formed of a housing part 170 and a cover 172 which encloses an air chamber 174 located between the cover 172 and a central partition 176 in part 170. The cover 172 is secured to the part 170 by a pair of screws 178 located as shown in FIG. 5. The side of the partition 176 facing the chamber 174 is contoured to provide an outer annular groove 180 and a centrally located cylindrical bore 182 having a closed right end 184 when viewed as in FIG. 6.

Extending between the groove 180 and the left end of the bore 182 is a circular concave surface 186 having a rounded outer rim 188 and an annular rounded ridge 190 located between the rim 188 and the bore 182. Extending to the left from the end 184 in the bore 182 is a boss 192 that provides a guide and seat for one end of a compression spring 194.

Extending inwardly from the right side of the part 170 to the partition 176 is an annular air chamber 196 which surrounds the outer walls of the part 170 forming the bore 182 and includes strategically spaced cylindrical protuberances 198 extending from the partition to free ends that are located to the left of a plane defining the right end of the part 170.

Figure 3:
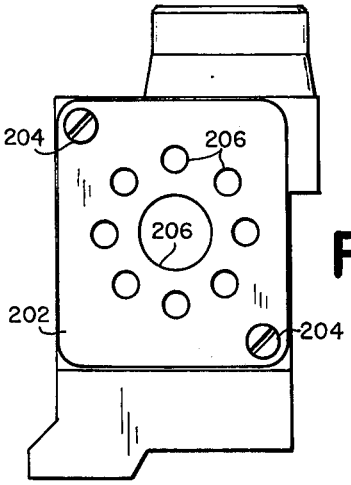
FIG. 3 is a side view of the timing attachment when viewed in the direction indicated by arrow 3 in FIG. 1.

The right side of the air chamber 196 is closed by a filter 200 and a cover 202. The filter 200 is circular in shape and preferably formed of felt or open-cell synthetic material and has its edges tightly pressed against the housing part 170 by the cover 202 when the cover is secured to the part 170 by screws 204, shown in FIG. 3. The cover includes openings 206 as shown in FIG. 3 which expose portions of the filter to permit substantially unimpeded passage of filtered air into the chamber 196. Preferably the chamber 196 is relatively large to assure fast response of the timing unit when the unit is adjusted for minimum time-delay action, as will be hereinafter described. An air passage 208, molded within the material of the housing part 170, extends from the chamber 196 to an opening in the front end 210 of the part 170 and an air passage 212, also molded within the part 170, extends from an opening in the front end 210 to an opening in the partition 176 that is preferably located in the ridge 190. Thus the chambers 196 and 174 are connected by the air passages 208 and 212, respectively, through openings in the front end 210.

A diaphragm assembly including an elastomeric diaphragm 214, a cylindrical member 216, a pin 218, the spring 194, a spring 220 and a timer button 222 is positioned in the chamber 174 so the button 222 extends through an opening 224 in the cover 172.

The diaphragm 214 is circular in shape and includes a peripheral bead that is received in the groove 180 and compressed to provide an air tight seal when the cover 172 is secured to the housing part 170 by screws 178. The diaphragm 214 is molded to have a shape shown in FIG. 6 wherein at the reset position it conforms to the contours of the conical surface 186, including the rim 188 and the ridge 190. Thus the diaphragm 214 has circular convolutions which allow the diaphragm 214 to flex axially during its timing action. The diaphragm 214 has a central opening through which the pin 218 extends with clearance. The button 222 is secured to the left end of the pin 218 and the spring 220 surrounds the pin 218 and is interposed between the button 222 and the surface of the diaphragm 124 surrounding its central opening. The cylindrical member 216 is secured to the right end of the pin 218 and is received in the bore 182. The member 216 has a nose portion 226 at its left end that engages portions of the diaphragm 214 surrounding its central opening with an air sealing engagement when the spring 220 urges the nose portion 226 into engagement with the diaphragm. The member 216 has a cylindrical interior which receives a projection extending from the right end 184 into the bore 182 with clearance so the spring 194 is positioned between the projection and the cylindrical interior of the member 216. The spring 194 is of the compression type and has one end seated on the right end 184 and an end engaging the left end of the cylindrical interior of the member 216 to constantly urge the diaphragm assembly to the left from the position shown in FIG. 6 wherein the button 222 is shown in full lines to the position wherein the button 222 is shown in broken lines. When the diaphragm assembly is at its timed-out state, e.g., when the parts of the assembly are positioned so the button 222 is located at the broken line position, the diaphragm will be urged by the spring 194 into engagement with the right side wall of the cover 172. The diaphragm assembly is moved to its reset position adjacent the surface 186 when an external force is applied to the left end of the button 222 in a manner to be later described. During the rightward movement of the diaphragm 214 to the reset position, the spring 220 will be compressed and the nose portion 226 will move out of engagement with the surface portions of the diaphram to provide a valve opening that surrounds the pin 218 to permit the escape of air from the area between the right surface of the diaphragm 214 and the conical surface 186. The release of the external force on the left end of the button 222, which occurs in a manner to be described, permits the spring 194 to move the nose portion 226 into sealing engagement with the surface portions of the diaphragm 214, thereby closing the central valve opening surrounding pin 218 and initiate the timing interval of the timing unit 44 during which the button 222 is moved from the reset position by the force supplied by the spring 194 from the position shown in full lines to the timed-out position shown by broken lines in FIG. 6. The rate at which the button 222 moves from the reset position to the timed-out position is controlled by a valve mechanism 230 which controls the rate at which filtered air is bled through the air passages 208 and 212 from the chamber 196 to the space or chamber 228 located between the right surface of the diaphragm 214 and the conical surface 186, as will now be described.

The front end 210 of the housing part 170 is provided with a substantially flat circular surface 232 through which the front ends of air passages 208 and 212 extend. The flat surface 232 is bounded by a raised cylindrical rim 234 to provide a cylindrical recess with a cylindrical hub 236, concentric with the rim 234 and extending forwardly from the surface 232. Extending inwardly in the cylindrical recess, and not shown, is an indexing nib which is received in a notch 238 in an elastomeric sealing disc 240 and a notch 242 in a timing disc 244, most clearly shown in FIG. 7.

The valve mechanism 230 also includes a transfer disc 246, an elastomeric sealing disc 248, an adjustment knob 250, a metal washer 252, a spring washer 254, a screw 256 and an indicating plate 258. The sealing disc 240, the timing disc 244, the transfer disc 246, the sealing disc 248 and the adjustment knob 250 are circular in shape and have central openings sized to receive the hub 236. The sealing disc 240 is positioned by its notch 238 in the cylindrical recess in tight air sealing engagement with the surface 232 surrounded by rim 234 so a pair of openings 260 and 262 extending through the disc 240 are aligned with the passages 208 and 212, respectively. The timing disc 244 is positioned by its notch 242 in the cylindrical recess so a rear surface on the disc 244 is in sealing engagement with the front surface on disc 240 and a pair of openings or ports 264 and 266 extending therethrough are aligned with openings 260 and 262, respectively. The passages 208 and 212, the openings 260 and 262 and the openings 264 and 266 are preferably arranged so the openings 264 and 266 are spaced along a common radius extending from the center of the disc 244. The transfer disc 246 is positioned in the cylindrical recess to have its rear surface pressed tightly against the front surface of the timing disc 244 to provide an air seal therebetween and includes suitable notches 268 which are received by projections, not shown, at the rear end of the knob for indexing and providing a non-rotatable coupling between the transfer disc 246 and the knob 250. The sealing washer 248 is positioned in the cylindrical recess between the rear surface of the knob 250 and the front surface of the transfer disc 246. The knob 250 is provided with a central opening which is journalled on the hub 236 and a cylindrical rim 270 at its rear end. The rim overlays the rim 234 to improve the appearance of the attachment and prevent the entry of foreign matter into the valve mechanism 230 and, if desired, may include indexing ridges, not shown, which may be aligned with indexing positions on the cover. The components of the valve mechanism 230 are maintained in the positions described by the spring washer 254, metal washers 252 and screw 256. The screw 256 extends through central openings in the metal washer 252 and spring washer 254 and is tightened in a threaded bore centrally located in the hub 236 to tightly press all of the components in the cylindrical recess in tight air-sealing engagement with each other. The indexing plate 258 is pressed into a suitable recess at the front end of the knob 250 to conceal the screw 256 and the washers 252 and 254 and includes suitable markings to indicate the rotated position of the knob 250.

The timing disc 244 has a pair of concentric grooves 272 and 274 formed on the surface 276 that is contacted by the transfer disc 246. The grooves 272 and 274 extend from the ports 264 and 266 respectively to closed ends 278 and 280 which are spaced from the ports 264 and 266, respectively. The transfer disc 246 has a radially elongated hole 282 interconnecting the grooves 272 and 274 to provide an air passage between the grooves 272 and 274 at any position over the entire length of the grooves 272 and 274. To provide the attachment 10 with an adjustable timing range adjustment that varies logarithmically with the adjusted position of the knob 250, i.e., a progressively decreasing range of adjustment as the knob is rotated to positions to provide increased time periods, the depth of the grooves 272 and 274 is profiled so the grooves become progressively shallower as the length of the grooves 272 and 274 from the ports 264 and 266 increases toward their closed dead ends 278 and 280, respectively, which in the preferred embodiment is located 30 angular degrees along a radius from the radius passing through the ports 264 and 266. In the embodiment shown, the washer 254 is preferably a wave washer and is compressed when the screw 256 is tightened to provide a uniform adjustable torque required to rotate the knob 250 as caused by the friction between the discs 244 and 246 when the transfer disc 246 is rotated relative to the timing disc 244 to change the timing period of the valve mechanism 230.

Figure 6:
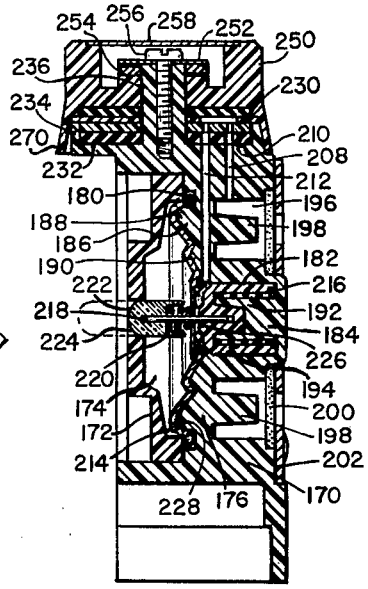
FIG. 6 is a cross-sectional view taken along line 6—6 in FIG. 5.

As shown in FIGS. 5 and 6, the button 222 extends through the opening 224 in the cover 172 and includes a pair of portions 284 and 286 at its free end that are spaced at opposite sides of a notch 288. The notch 288 receives a portion 290 located between the tabs 122 and 126 on the mode selecting member 62 when the button 222 is at its timed-out position illustrated by the broken lined position in FIG. 6. The portion 284 is engaged by the free ends 166 or 169 when the button 222 is moved to the reset position and the portion 286 engages portions 292 or 294 on the levers 64 and 66, respectively, during movement of the button 222 to the timed-out position.

The operation of the timing unit 44 is as follows. The timing unit 44 is reset when a suitable force causes the levers 54 or 56 to rotate in a direction to supply a force on the button portion 284 which causes the button 222 to move to the full line position shown in FIG. 6, whereat the diaphragm 214 is positioned adjacent the surface 186 and the spring 194 is compressed. The timing period is initiated when the programmed lever 54 or 56 moves out of engagement with the button portion 284. The release of the button 222 permits the spring 194 to move the diaphragm 214 and the button 222 toward the timed-out position, shown in broken lines in FIG. 6, at a rate controlled by the valve mechanism 230. As previously stated, the rate at which the button 222 moves from the reset position to the timed-out position is controlled by the valve mechanism 230 which controls the rate at which filtered air is bled through the air passages 208 and 212 from the chamber 196 to the space or chamber 228 located between the right surface of the diaphragm 214 and the conical surface 186, as shown in FIG. 6. During the movement of the diaphragm 214 toward the timed-out position, filtered air flows through the passage 208 through a path that includes the opening 260 in the sealing disc 240, the opening 264 in the timing disc 244, the length of the groove 272 in the timing disc 244, as determined by the location of the hole 282 in the transfer disc 246. The air flow in the groove 272 is transferred through the hole 282 to the groove 274 and is continued through the groove 274, the hole 266 in the timing disc 244, the hole 262 in the sealing disc, and the air passage 212 to the chamber 228. The rate of air flow between the chambers 196 and 228 is controlled by the length of the grooves 272 and 274 through which the air travels as determined by the position of the hole 282 which causes the transfer of air from the groove 272 to the groove 274. When the transfer disc 246 is located so the hole 282 is positioned to interconnect the openings 264 and 266, the timing unit 44 will operate with a minimum time delay period. The time delay period is progressively increased as the knob 250 is rotated to move the transfer disc 246 clockwise relative to the timing disc 240 in FIG. 7. When the hole 282 is located to bridge the portions of the groove adjacent the ends 278 and 280, the time delay period will be maximum as the air will be required to flow through the entire length of the grooves 272 and 274. The movement of the button 222 to the timed-out position will cause the portion 286 to engage the portions 292 or 294 on the programmed latch levers 64 or 66 to move the programmed levers 64 or 66 to a released position as will now be described in connection with the diagrammatic view of the parts of the attachment shown in FIG. 10.

Figure 7:
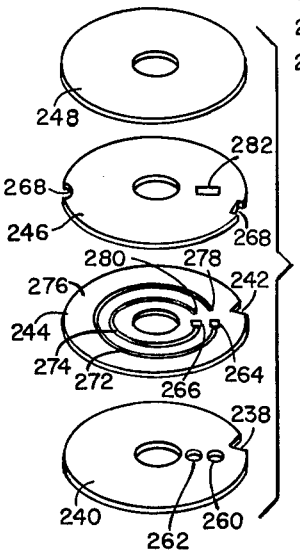
FIG. 7 is an exploded view showing in perspective certain components that provide the timing function in the attachment.
Figure 10:
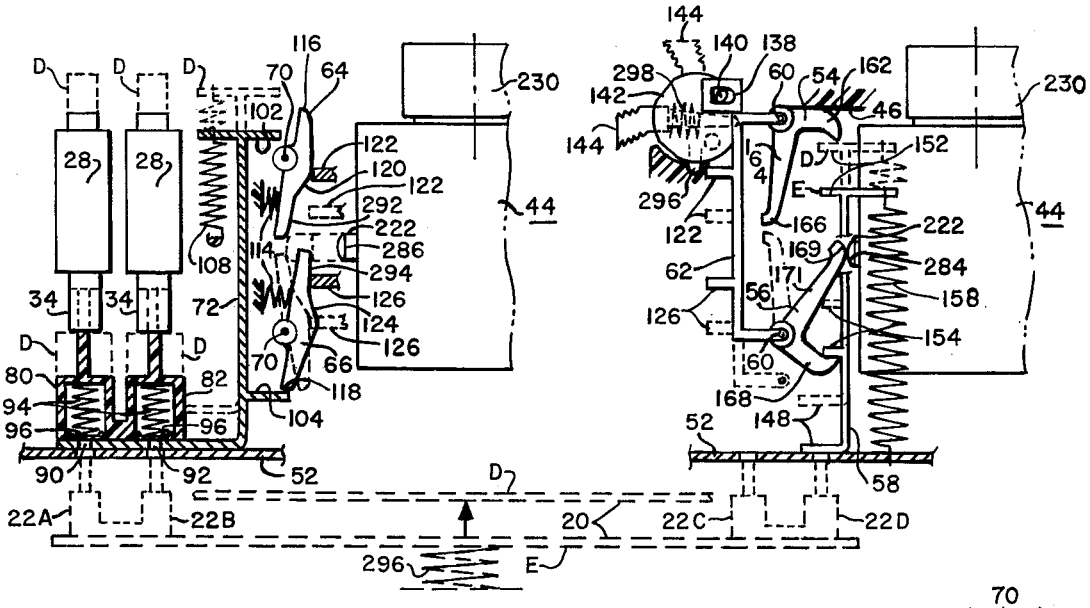
FIG. 10 is a diagrammatic view illustrating the various components of the attachment according to the present invention.

The components of the attachment 10 as shown in FIGS. 8 and 9 which are assembled as illustrated in FIG. 4, are diagrammatically illustrated and designated in FIG. 10 by the same numerical designations as used in FIGS. 8, 9 and 4. Also, the components of the basic relay 12 as described in connection with FIG. 2 and the timing unit 44, as illustrated in FIGS. 6 and 7 which provide the functions illustrated in FIG. 10, will be similarly designated in FIG. 10. As previously described in connection with FIG. 2, when the relay 12 is energized, the levers 18 and 20 rotate counterclockwise and clockwise, respectively, against the force exerted by a pair of springs 296, one of which is shown in FIG. 2. The rotation of the lever 18 through the plungers in plunger row 22 causes the actuation of the switch modules 28 in the housing part 26 to occur simultaneously with the energization of the relay 12. The position of the lever 20 when the relay is de-energized and energized is shown by the broken lines D and E respectively in FIG. 10. The spring 296 constantly urges the lever toward the de-energized position D. The movement of the lever 20 will cause a movement of four plungers 22A, 22B, 22C and 22D in the plunger row 22. The plungers 22A–D have distal ends movable in suitably located openings in the plate 52 with the distal ends of the plungers 22A and 22B extending through the openings 90 and 92 respectively in the member 72 into engagement with the spring seats 96 associated with the cylindrical portions 80 and 82, respectively. The plunger 22C, which also has a distal end movable in an opening in plate 52, provides no useful function when the attachment 10 is secured to the relay 12 and is merely shown in FIG. 10 because of the presence of four plungers in plunger row 22. The plunger 22D has its distal end engaging the foot portion 148 of the slide 58 and causes the slide 58 to be positioned at a broken line position D when the lever 20 is at the position D.

The timing attachment 10 may be programmed to operate in an OFF delay or an ON delay mode of operation which is controlled by the position of the mode selecting member 62 in the attachment 10, as will be hereinafter described. The timing attachment 10 is programmed to operate in the OFF delay mode when the member 62 is positioned as shown in full lines and in the ON delay mode when the member 62 is positioned in the position indicated by the broken lines in FIG. 10. As previously described, the member 62 carries pivot pins 60 for the levers 54 and 56 and includes tabs 122 and 126. When the member 62 is positioned as shown in full lines to program the attachment 10 to operate in the OFF delay mode, the tab 122 will engage the surface 120 which is located relative to the pivot pin 70 for the lever 64 to cause the lever 64 to be rotated against the force of its associated spring 114 to an inactive position whereat the latch surface 116 is prevented from engaging the surface 102 on the member 72. Also, when the member 62 is positioned at the OFF delay mode position, the lever 54 will be positioned so its arm portion 162 engages a portion of the front end of the housing part 47 to position the lever 54 at a location whereat a free end 166 on the arm 164 is prevented from engaging the portion 284 on the button 222. The positioning of the member 62 at the OFF delay position will also permit the levers 56 and 66 to operate in a manner to be hereinafter described.

When the member 62 is positioned as shown in broken lines to program the attachment 10 to operate in the ON delay mode, the tab 126 will engage the surface 124 which is located relative to the pivot pin 70 for the lever 66 to cause the lever 66 to be rotated against the force of its associated spring 114 to an inactive position whereat the latch surface 118 is prevented from engaging the surface 104 on the member 72. Also, when the member 62 is positioned at the ON delay mode position, the lever 56 will be positioned so its arm portion 168 will not be moved by the tab 154 during movement of the slide 58 to prevent the free end 169 from moving the portion 284 on the button 222. The positioning of the member 62 at the ON delay position will also permit the levers 54 and 64 to operate in a manner to be hereinafter described.

When the relay 12 is de-energized and the member 62 is positioned as shown in full lines to program the attachment 10 to operate in the OFF delay mode, the following conditions will prevail within the attachment. The member 62 will position the levers 54 and 64 in their inactive positions, the lever 20 will be at its position D, the plungers 22A, B and D will cause the slide 58 to be in its position D as illustrated by the broken lines, and the member 72 to be at its position D, as illustrated by the broken lines. The tab 126 will be positioned so the lever 66 may be rotated by the button 222 and permit the button 222 to be in the timed-out position whereat the portion 286 engages the portion 294 on the free end of the lever 66 and position the lever 66 as shown in broken lines, whereat the latch surface 118 is no longer engaging the surface 104. Additionally, as the lever 20 is at the position D and the surface 118 is no longer engaging the surface 104, the member 72 will have its foot portion positioned as shown by broken lines which will cause the cylindrical portions 80 and 82 to be positioned as shown by the broken lines and the plungers 34 of the switch modules 28 to be moved to the position shown by broken lines D. As the modules 28 may be positioned to provide either a normally closed or normally open contact operation when the plungers 34 of the switch are at the broken line position D, further description of the contact operation will not be detailed as the mode of contact operation in the switch modules 28 is not dependent upon the mode of operation of the timing attachment 10.

The energization of the relay 12 will cause the lever 20 to move to the position E which permits the slide 58 to move in response to the force provided by the spring 158 from the broken line position D to the position E, shown in full lines. The tab 154, during the movement of the slide 58 from the position D to the position E, will engage the arm 168 on lever 56 and rotate the lever clockwise to a position whereat the end 169 engages the portion 284 and moves the button 222 in the timing unit 44 to the reset position. The movement of the button 222 to the reset position also causes the portion 286 to move out of engagement with the end 294 which permits the spring 114 associated with the lever 66 to move the lever 66 in a clockwise direction to a position whereat the latch surface 118 is positioned to engage the surface 104 when the relay 12 is subsequently de-energized to prepare the attachment 12 for its OFF delay mode of operation which is initiated upon de-energization of the relay 12.

The de-energization of the relay 12 will cause the lever 20 to move from the position E to the position D and the slide 58 to move from its position E to the position D. The movement of the slide 58 to the position D will release the force supplied through the tab 154 on the lever 56 which maintained the button 222 at its reset position.

Thus the button 222 is free to move from its reset position to its timed-out position at a rate controlled by the timing mechanism, 230. The movement of the lever 20 to the position D also causes a similar movement of the plungers 22A and 22B. However, during the OFF delay time period, the latch surface 118 on the lever 66 engages the surface 104 and prevents the movement of the plungers 22A and 22B from moving the member 72 as the springs 96 are compressed to accommodate the movement of the plungers 22A and 22B while the member 72 is latched against movement by the lever 66. At the end of the timing period, the portion 286 engages the surface 294 and causes the lever 66 to rotate counterclockwise and release the latching engagement between the latch surface 118 and the surface 104. The released member 72 thus is moved upwardly by the force exerted by the previously compressed springs 96 to its position D which causes the cylindrical members 80 and 82 to move the plungers 34 in the switch modules 28 to their original positions when the relay is de-energized.

When the relay 12 is de-energized and the member 62 is positioned as shown in broken lines to program the attachment 10 to operate in the ON delay mode, the following conditions will prevail within the attachment 10. The member 62 will position the levers 56 and 66 in their inactive positions, the lever 20 will be at its position D, the plunger 22D will cause the slide 58 to be in the position D illustrated by the broken lines, and the member 72 will be at the position D illustrated by the broken lines. The tab 152 will be at its broken line position and cause the lever 54 to be rotated to a position whereat its end 166 engages the portion 284 and maintains the button 222 of the timing unit 44 at its reset position. Also, as the button 222 is at its reset position, the portion 286 will be at its full line position which permits the spring 114 associated with the lever 64 to position the latch surface 116 in a position to engage the surface 102. Additionally, as the lever 20 is at the position D and the surface 118 is prevented from engaging the surface 104, the member 72 will have its foot portion located as shown by broken lines which will cause the cylindrical portions 80 and 82 to be positioned as shown by the broken lines and the plungers 34 of the switch modules 28 to be moved to the position shown by broken lines D.

The energization of the relay 12 will cause the lever 20 to move to the position E which permits the slide 58 to move in response to the force provided by the spring 158 from the broken line position D to the position E, shown in full lines. The movement of the slide 58 to the position E will cause the tab 152 to move out of engagement with the arm 162 to initiate the timing period as the lever 54 is rotated clockwise by the force supplied by the button 222 during the movement of the button from its reset position to its timed-out position. At the end of the timing period, the button 222 will be at its timed-out position and the portion 286, through its engagement with the portion 292 on the lever 64, will position the lever 64 so the latch surface 116 releases the surface 102. The release of the surface 102 permits the member 72 to be moved from its position D to its position E, shown in full lines. The movement of the member 72 to the position E will cause the cylindrical positions 80 and 82, as well as the plungers 34, to move from their broken line positions to their full line positions where they are maintained as long as the relay 12 remains energized.

The de-energization of the relay 12 after the ON delay timing period has expired will cause the following to occur. Prior to the de-energization of the relay 12, the engagement between the portion 286 and the portion 292 will maintain the lever 64 in a releasing position with the surface 102, the engagement between the tab 126 and the surface 124 will maintain the lever 66 at its inactive position, the engagement between the portion 284 and end 166 will maintain the lever 54 at its furthest clockwise position and the lever 56 will be inactive as no force is applied to its arm 168. The de-energization of the relay 12 will cause the lever 20 to move from its position E to its position D and the plungers 22A–D to move to their de-energized positions. The movement of the plunger 22D causes the member 58 and the tab 152 to move to the position D. The movement of the tab 152 to the position D causes the tab 152 to engage the arm 162 and the lever 54 to rotate counterclockwise to a position whereat the end 166 causes the button 222 to be at its reset position. The movement of the plungers 22A and 22B, as imparted through the spring seats 96 and the springs 94 causes the cylindrical portions 80 and 82 as well as the plungers 34 to move to their de-energized, or broken line positions D. Also, when the button 222 is at its reset position where it is maintained by the lever 54, the portion 286 will be out of engagement with the surface portion 292 so the lever 64 is positioned by its associated spring 114 to engage the surface 102 to program the attachment for an ON time delay operation when the relay 12 is subsequently energized.

Also, as shown in FIG. 10, the position of the mode selecting member 62 in the attachment 10 to provide the ON delay and OFF delay timing functions is readily accomplished by positioning the part 142 in a selected rotated position in its associated recess. The part 142 has a projection 140 that is received in the elongated opening 138 and includes a handle 144 and a detent mechanism illustrated by a projection 296 on the handle 144. The projection 296 has a tip receivable in either of two notches in the housing part 47. The projection 296 is constantly urged by a spring 298 to a position where the tip is positioned in one of the notches. Thus when a change in the timing mode of the attachment 10 is necessary, all that is required is to pull the handle 144 outwardly to disengage the tip on projection 296 from its notch, i.e., a notch programming the attachment for an OFF delay operation, and rotate the part 142 to a position where the projection 296 tip is aligned with a notch which programs the attachment 10 for an ON delay operation where it is maintained when the force on the handle 144 is released. During the rotation of the part 142 the rotative movement of the part 142 is translated to a linear movement of the member 62 as the projection 140 moves in the elongated opening 138.

As shown in FIGS. 1, 4 and 5, the timing unit 44 is secured to the latch and switch unit 46 by suitable screws, not shown, which extend through bores 300 in the timing unit 44 into threaded openings 302 in the unit 46 to provide a unitary assembly heretofore described as the attachment 10. The attachment 10 is secured to the front end of the relay 12 by a screw 304 which extends through a suitable opening in the cover portion 30 into a threaded opening in the relay 12. Additionally, the attachment 10 is secured on the front side of the relay 12 by a spring clip 306 that has one end secured on the relay 12 by a screw 308 and its other end 310 positioned by a resilient arm portion 312 to be positioned on a ledge 314 on the latch and switch unit 46. Thus all that is required to remove the attachment 10 from the front end of the relay 12 to provide access to the switch modules 28 in the sockets in the housing part 26 is to loosen the screw 304 and pry the end 310 from its engaging position with the ledge 314. The front end of the housing part 47 is closed by a cover 316 which is secured to the housing part 47 by a single screw 318 to position the switch modules 28 and engage portions on the plungers 34 of the switch modules 28 to cause the normally open and the normally closed contact operation of the modules, as disclosed in the Karch et al. patent, supra. The cover 316 includes a pair of openings 320 which permit observation of the position of the plungers 34 during timing periods which may be electromagnetically initiated as previously described or manually initiated by depressing a plunger 322 which is part of the structure of the relay 12, as described in the Karch et al. patent.

As described in the Karch et al. patent, the switch modules 28 have springs therein to provide the normally open and normally closed contact operation of the modules 28 which is dependent upon the orientation of the modules 28 in their associated sockets. When the modules 28 in the attachment 10 are positioned in their associated sockets to provide a normally closed contact operation, the springs within the modules 28 will cause the plungers 34 in the modules 28 and the member 72 to move from the broken line position to the position shown in full lines, in response to the energization of the relay 12 without assistance. However, when both modules 28 are positioned in their associated sockets to provide a normally open contact operation, the force provided by the springs within the modules 28 is less than the force provided when the modules are programmed for normally closed contact operation and the spring 108, as shown in FIGS. 4 and 10, supplies the additional force which assures the movement of the plungers and the member 72 to their respective full line positions.

As previously described, the cover 316 is secured to the front end of the attachment 10 by a single screw 318. Thus conversion of the modules 28 within the attachment to provide a normally closed or normally open contact operation of the two modules 28 within the attachment may be accomplished by merely removing the cover 316, inverting the modules in their associated sockets as required, and replacing the cover 316 without disturbing any wired connection to the attachment 10. Further, as shown in FIG. 1, and as previously described, the adjustment knob 250 and the handle 144 are clearly apparent and accessible at the front side of the attachment. Thus the timing periods of the attachment may be easily changed by rotating the knob to a desired position indicated by the plate 258 and the mode of operation of the attachment 10 programmed by positioning the handle 144 as described without the use of tools or changing the position of the attachment on the relay 12 as is required in similar devices heretofore known.

While certain preferred embodiments of the invention have been specifically disclosed, it is understood that the invention is not limited thereto, as many variations will be readily apparent to those skilled in the art and the invention is to be given its broadest possible interpretation within the terms of the following claims:

What is claimed is:

1. A timed delay device arranged for alternately providing either an ON delay or an OFF delay operation of a switch operator, comprising: a switch actuator movable between a first operated position and a second operated position for moving the switch operator from a first to a second position, a resettable timing unit having an operator movable from a reset position to a timed-out position during a regulated timed period, a first spring-biased latch having a portion releasably engaging the switch actuator for maintaining the switch actuator at its first position when the first latch is positioned in a latching position and a portion engageable with the timing unit operator for positioning the first latch in a released position when the timing unit operator is in its timed-out position, a second spring-biased latch having a portion releasably engaging the switch actuator for maintaining the switch actuator at its second position when the second latch is positioned in a latching position and a portion engageable with the timing unit operator for positioning the second latch in a released position when the timing unit is in its timed-out position, a first reset lever having a portion engageable with the timing unit operator for moving the timing unit operator to the reset position when the first reset lever is moved from a first position to a second position, a second reset lever having a portion engageable with the timing unit operator for moving the timing unit operator to the reset position when the second reset lever is moved from a first to a second position, a timing unit actuator moveable between a first position and a second position and having a portion engageable with a portion on the first reset lever for moving the first reset lever from its first position to its second position when the timing unit actuator is moved from its second position to its first position and a portion engageable with a portion on the second reset lever for moving the second reset lever from its first position to its second position when the timing unit actuator is moved from its first to its second position, and a mode selector movable to a first mode selected position and a second mode selected position and having a portion engageable with the first latch for maintaining the first latch in its released position and a portion positioning the first reset lever in its first position when the mode selector is at its first position and a portion engageable with the second latch for maintaining the second latch in its released position and a portion positioning the second reset lever in its first position when the mode selector is at its second position.

2. The timed delay device as recited in claim 1 wherein the first reset lever and the second reset lever are pivotally mounted on the mode selector and include portions which engage portions of a housing for the device when the mode selector positions the reset levers in their first positions.

3. The timed delay device as recited in claim 1 wherein the first and the second latches are identical in shape.

4. The timed delay device as recited in claim 1 wherein the first and the second reset levers are identical in shape.

5. The timed delay device as recited in claim 1 wherein the timing unit includes a valve comprising two discs having flat contacting surfaces, said parts being slideably adjustable relative to each other with said surfaces in contact, a first of said pair of discs having a pair of ports extending therethrough centered on a common radius and a pair of concentric grooves in its contacting surface with each of said grooves extending from a port to an end that is spaced from its associated port, and a second of said pair of discs having a passage in its contacting surface extending between the concentric grooves on the first disc providing a path for the transfer of air between the grooves.

6. The timed delay device as recited in claim 1 wherein the movement of the switch actuator and the timing unit actuator to their respective first and second positions is provided by an electromagnet.

7. An electromagnetically operated timing device comprising: an electromagnet assembly including a magnet coil and an armature movable from a first to a second position upon energization of the coil, means including a plurality of plungers movable from a first to a second position in response to the movement of the armature from the first to the second position a switch including a stationary contact, a movable contact, and a switch operator, a switch actuator movable from a first position to a second position in response to the movement of a first of the plurality of plungers from the first to the second position for moving the switch operator and the movable contact from a first to a second operated position, a resettable timing unit having an operator movable from a reset position to a timed-out position during a regulated timed period, an ON delay spring biased latch having a portion releasably engaging the switch actuator for maintaining the switch actuator at its first position when the ON delay latch is in a latching position and a portion engageable with the timing unit operator for positioning the ON delay latch in a released position to permit movement of the switch actuator to its second position when the timing unit operator is at its timed-out position, an OFF delay spring biased latch having a portion releasably engaging the switch actuator for maintaining the switch actuator at its second position when the OFF delay latch is in a latching position and a portion engageable with the timing unit operator for positioning the OFF delay latch in a released position to permit movement of the switch actuator to its first position when the timing unit operator is at its timed-out position, an ON delay reset lever having a portion engageable with the timing unit operator for moving the timing unit operator to its reset position when the ON delay lever is moved from an inactive position to an actuating position, an OFF delay reset lever having a portion engageable with the timing unit operator for moving the timing unit operator to its reset position when the OFF delay latch is moved from an inactive position to an actuating position, a timing unit actuator movable from a first position to a second position in response to the movement of a second of the plurality of plungers from the first to the second position, said timing unit actuator having a first portion engageable with a portion on the ON delay reset lever for moving the ON delay reset lever from its inactive to its actuated position when the timing unit actuator is moved from its second to its first position and a second portion engageable with a portion on the OFF delay reset lever for moving the OFF delay reset lever from its inactive to its actuated position when the timing unit actuator is moved from its first to its second position, and a timing mode selector movable to an ON delay position and an OFF delay position, said mode selector having a portion engaging the OFF delay latch for maintaining the OFF delay latch in its released position and a portion positioning the OFF delay reset lever in its inactive position when the mode selector is at its ON delay position and a portion engaging a portion on the ON delay latch for maintaining the ON delay latch in its released position and a portion positioning the ON delay reset lever in its inactive position when the mode selector is at its OFF delay position.

8. The timed delay device as recited in claim 7 wherein the timing unit includes a valve comprising two discs having flat contacting surfaces, said parts being slideably adjustable relative to each other with said surfaces in contact, a first of said pair of discs having a pair of ports extending therethrough centered on a common radius and a pair of concentric grooves in its contacting surface with each of said grooves extending from a port to an end that is spaced from its associated port, and a second of said pair of discs having a passage in its contacting surface extending between the concentric grooves on the first disc providing a path for the transfer of air between the grooves.

9. The timing device as recited in claim 7 wherein the device includes a housing having a socket and the switch is positioned in either of two inverted positions in the socket to provide a normally open or a normally closed contact operation.

10. The timing device as recited in claim 9 wherein the operator of the switch is spring-biased and urges the switch operator toward its second position when the switch is positioned in the socket to provide a normally closed contact operation and the device includes an auxiliary spring for urging the switch actuator toward its second position when the switch is positioned in the socket to provide a normally open contact operation.

11. The timing device as recited in claim 7 wherein the timing mode selector includes a linearly movable part carrying the portions which engage the OFF and the ON delay latches and portions which position the reset levers and a rotatable part having a bell crank connection with the linearly movable part and a portion externally accessible of a housing for the device whereby the rotatable part when rotated to either of two selected positions causes the device to be programmed to operate in the OFF or ON delay modes.

* * * * *

UNITED STATES PATENT OFFICE

CERTIFICATE OF CORRECTION

Patent No. 4,030,054 Dated June 14, 1977

Inventor(s) Rudolf H. Kiessling

It is certified that error appears in the above-identified patent and that said Letters Patent are hereby corrected as shown below:

Col. 1, line 39, "he" should read --the--.

Col. 3, line 54, "housing 6" should read --housing 26--.

Col. 16, line 54, after "position" insert a comma (,).

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*